US006554256B2

(12) United States Patent
Ochoa

(10) Patent No.: US 6,554,256 B2
(45) Date of Patent: Apr. 29, 2003

(54) HIGHWAY GUARDRAIL END TERMINAL ASSEMBLY

(75) Inventor: Carlos M. Ochoa, Dallas, TX (US)

(73) Assignee: ICOM Engineering, Inc., Plano, TX (US)

( * ) Notice: Subject to any disclaimer, the term of this patent is extended or adjusted under 35 U.S.C. 154(b) by 23 days.

(21) Appl. No.: 09/844,169

(22) Filed: Apr. 25, 2001

(65) Prior Publication Data

US 2002/0158241 A1 Oct. 31, 2002

(51) Int. Cl.[7] ..... E01F 15/00
(52) U.S. Cl. ..... 256/13.1; 404/6; 404/10
(58) Field of Search ..... 404/6, 9, 10; 256/13.1

(56) References Cited

U.S. PATENT DOCUMENTS

| | | | | |
|---|---|---|---|---|
| 1,847,025 | A | 2/1932 | Stockard | |
| 1,849,167 | A | 3/1932 | Bente | |
| 1,974,232 | A | 9/1934 | Brown | 256/13.1 |
| 1,989,763 | A | 2/1935 | McFarland | 256/18.1 |
| 2,007,185 | A | 7/1935 | Edgecombe | 256/13.1 |
| 2,047,436 | A | 7/1936 | Shepherd | 256/13.1 |
| 2,047,990 | A | 7/1936 | Carswell et al. | 256/13.1 |
| 2,060,673 | A | 11/1936 | Hick | 256/13.1 |
| 2,085,098 | A | 6/1937 | Height et al. | 256/13.1 |
| 2,088,001 | A | 7/1937 | Schulz | 256/13.1 |
| 2,089,929 | A | 8/1937 | Brickman et al. | 256/13.1 |
| 2,091,195 | A | 8/1937 | Dennebaum | 267/69 |
| 2,091,925 | A | 8/1937 | Heltzel | 256/13.1 |
| 2,135,705 | A | 11/1938 | Florance | 256/13.1 |
| 2,168,930 | A | 8/1939 | Bradshaw | 256/13.1 |
| 2,204,559 | A | 6/1940 | Ahles | 256/13.1 |
| 2,228,652 | A | 1/1941 | Dailey | 256/13.1 |
| 2,536,760 | A | 1/1951 | Martin et al. | 256/13.1 |
| 2,776,116 | A | 1/1957 | Brickman | 256/13.1 |
| 2,979,307 | A | 4/1961 | Crone | 256/13.1 |
| 3,214,142 | A | 10/1965 | Brown et al. | 256/13.1 |

(List continued on next page.)

FOREIGN PATENT DOCUMENTS

| | | | |
|---|---|---|---|
| CH | 376 535 | 2/1960 | |
| CH | 378 358 | 6/1961 | |
| CH | 401 121 | 10/1965 | E01F/15/00 |
| CH | 433422 | 8/1966 | E01F/15/00 |
| CH | 433 422 | 8/1966 | E01F/15/00 |
| EP | 0 379 424 | 7/1990 | E01F/15/00 |
| FR | 1 258 539 | 7/1961 | |
| FR | 2 607 841 | 6/1988 | E01F/15/00 |
| WO | WO 97/25482 | 7/1997 | E01F/15/00 |
| WO | WO 00/49232 | 8/2000 | E01F/15/04 |

OTHER PUBLICATIONS

PTC Search Report U.S. 99/29848.

Standard Specification for Corrugated Sheet Steel Beams for Highway Guardrail AASHTO Designation: M 180–89 pp. 309–313.

Standard Specification for Corrugated Sheet Steel Beams for Highway Guardrail AASHTO Designation: M 180–79 pp. 419–423.

(List continued on next page.)

*Primary Examiner*—Gary S. Hartmann
(74) *Attorney, Agent, or Firm*—Baker Botts L.L.P.

(57) ABSTRACT

An end terminal assembly of a highway guardrail system to enhance safety of a vehicle impacting an end of the guardrail facing oncoming traffic. The guardrail system includes a W-beam type guardrail mounted on a plurality of posts adjacent to the side of a highway. The guardrail includes at least one W-shaped beam having a first edge curl and a second edge curls. A kinetic energy absorbing assembly is integrally engaged with the one end of guardrail to stretch portions of at least one W-shaped beam to dissipate energy from an impacting vehicle. An anchor assembly may be provided as part of the end terminal assembly to provide tension support as desired for the guardrail during rail face impacts and a cable anchor bracket which releases from the guardrail during a head on impact with the end of the guardrail.

9 Claims, 7 Drawing Sheets

U.S. PATENT DOCUMENTS

| | | | | | |
|---|---|---|---|---|---|
| 3,284,054 | A | | 11/1966 | St. Pierre | 256/13.1 |
| 3,332,666 | A | | 7/1967 | Gray | 256/13.1 |
| 3,417,965 | A | | 12/1968 | Gray | 256/13.1 |
| 3,603,562 | A | | 9/1971 | Glaesener | 256/13.1 |
| 3,776,520 | A | | 12/1973 | Charles et al. | 256/13.1 |
| 3,845,936 | A | | 11/1974 | Boedecker, Jr. et al. | 256/1 |
| 4,063,713 | A | | 12/1977 | Anolick et al. | 256/13.1 |
| 4,222,552 | A | | 9/1980 | Matteo, Sr. | 256/13.1 |
| 4,295,637 | A | | 10/1981 | Hulek | 256/13.1 |
| 4,330,106 | A | | 5/1982 | Chisholm | 256/13.1 |
| 4,423,854 | A | | 1/1984 | Cobb et al. | 256/13.1 |
| 4,460,161 | A | | 7/1984 | Grenga | 256/13.1 |
| 4,655,434 | A | | 4/1987 | Bronstad | 256/13.1 |
| 4,678,166 | A | | 7/1987 | Bronstad et al. | 256/13.1 |
| 4,815,565 | A | | 3/1989 | Sicking et al. | 188/32 |
| 4,928,928 | A | | 5/1990 | Buth et al. | 256/13.1 |
| 5,044,609 | A | | 9/1991 | Cicinnati et al. | 256/13.1 |
| 5,069,576 | A | | 12/1991 | Pomero | 404/6 |
| 5,078,366 | A | * | 1/1992 | Sicking et al. | 188/377 |
| 5,152,507 | A | | 10/1992 | Lee | 256/13.1 |
| 5,391,016 | A | | 2/1995 | Ivey et al. | 404/6 |
| 5,407,298 | A | | 4/1995 | Sicking et al. | 404/6 |
| 5,429,449 | A | | 7/1995 | Baatz | 404/6 |
| 5,503,495 | A | | 4/1996 | Mak et al. | 404/6 |
| 5,547,309 | A | | 8/1996 | Mak et al. | 404/6 |
| 5,775,675 | A | | 7/1998 | Sicking et al. | 256/13.1 |
| 5,791,812 | A | * | 8/1998 | Ivey | 256/13.1 |
| 5,860,762 | A | | 1/1999 | Nelson | 404/6 |
| 5,924,680 | A | * | 7/1999 | Sicking et al. | 256/13.1 |
| 5,931,448 | A | | 8/1999 | Sicking et al. | 256/13.1 |
| 5,954,111 | A | | 9/1999 | Ochoa | 160/201 |
| 5,957,435 | A | | 9/1999 | Bronstad | 256/13.1 |
| 5,967,497 | A | | 10/1999 | Denman et al. | 256/13.1 |
| 5,988,598 | A | | 11/1999 | Sicking et al. | 256/13.1 |
| 6,022,003 | A | | 2/2000 | Sicking et al. | 256/13.1 |
| 6,059,487 | A | | 5/2000 | Haga et al. | 404/6 |
| 6,082,429 | A | | 7/2000 | Ochoa | 160/201 |
| 6,089,782 | A | * | 7/2000 | Bligh et al. | 404/6 |
| 6,109,597 | A | | 8/2000 | Sicking et al. | 256/13.1 |
| 6,129,342 | A | | 10/2000 | Bronstad | 256/13.1 |
| 6,142,452 | A | | 11/2000 | Denman et al. | 256/13.1 |
| 6,149,134 | A | | 11/2000 | Bank et al. | 256/13.1 |
| 6,173,943 | B1 | * | 1/2001 | Welch et al. | 256/13.1 |
| 6,220,575 | B1 | | 4/2001 | Lindsay et al. | 256/13.1 |
| 6,244,571 | B1 | * | 6/2001 | Reid et al. | 256/1 |
| 6,254,063 | B1 | | 7/2001 | Rohde et al. | 256/13.1 |
| 6,260,827 | B1 | | 7/2001 | Sicking et al. | 256/13.1 |
| 6,299,141 | B1 | * | 10/2001 | Lindsay et al. | 256/13.1 |
| 6,308,809 | B1 | | 10/2001 | Reid et al. | 18/388 |
| 6,416,041 | B1 | | 7/2002 | Sicking et al. | 256/13.1 |
| 2001/0013596 | A1 | | 8/2001 | Sickling et al. | 256/13.1 |
| 2002/0007994 | A1 | | 1/2002 | Reid et al. | 188/377 |

OTHER PUBLICATIONS

U.S. pending application Ser. No. 09/405434 entitled "Guardrail Beam with Enhanced Stability" by Carlos Ochoa, filed Sep. 23, 1999.

U.S. pending continuation–in–part patent application Ser. No. 09/663327 entitled "Guardrail Beam with Enhanced Stability" by Carlos Ocha, filed Sep. 18, 2000.

U.S. patent continuation–in–part application Ser. No. 09/753868 entitled "Guardrail with Improved Edge Flange and Method of Manufacture" by Carlos Ochoa, filed Jan. 2, 2001.

Existing Guardrail Shapes.

O–Rail (brouchure), TrinityIndustries, Inc., 1999.

Existing Guardrail Shapes

O–Rail (brouchure), TrinityIndustries, Inc. 1999.

Standard Specification for Corrugated Sheet Steel Beams for Highway Guardrail, AASHTO Designation: M 180–89, pp. 309–313.*

Standard Specification for Corrugated Sheet Steel Beams for Highway Guardrail, AASHTO Designation: M 180–79, pp. 419–423.*

PCT Search Report U.S. 99/29848.*

PCT Search Report for PCT/US 02/11005 Mailed Jul. 18, 2002.

PCT Search Report for PCT/US 01/45265 Mailed Jun. 26, 2002.

* cited by examiner

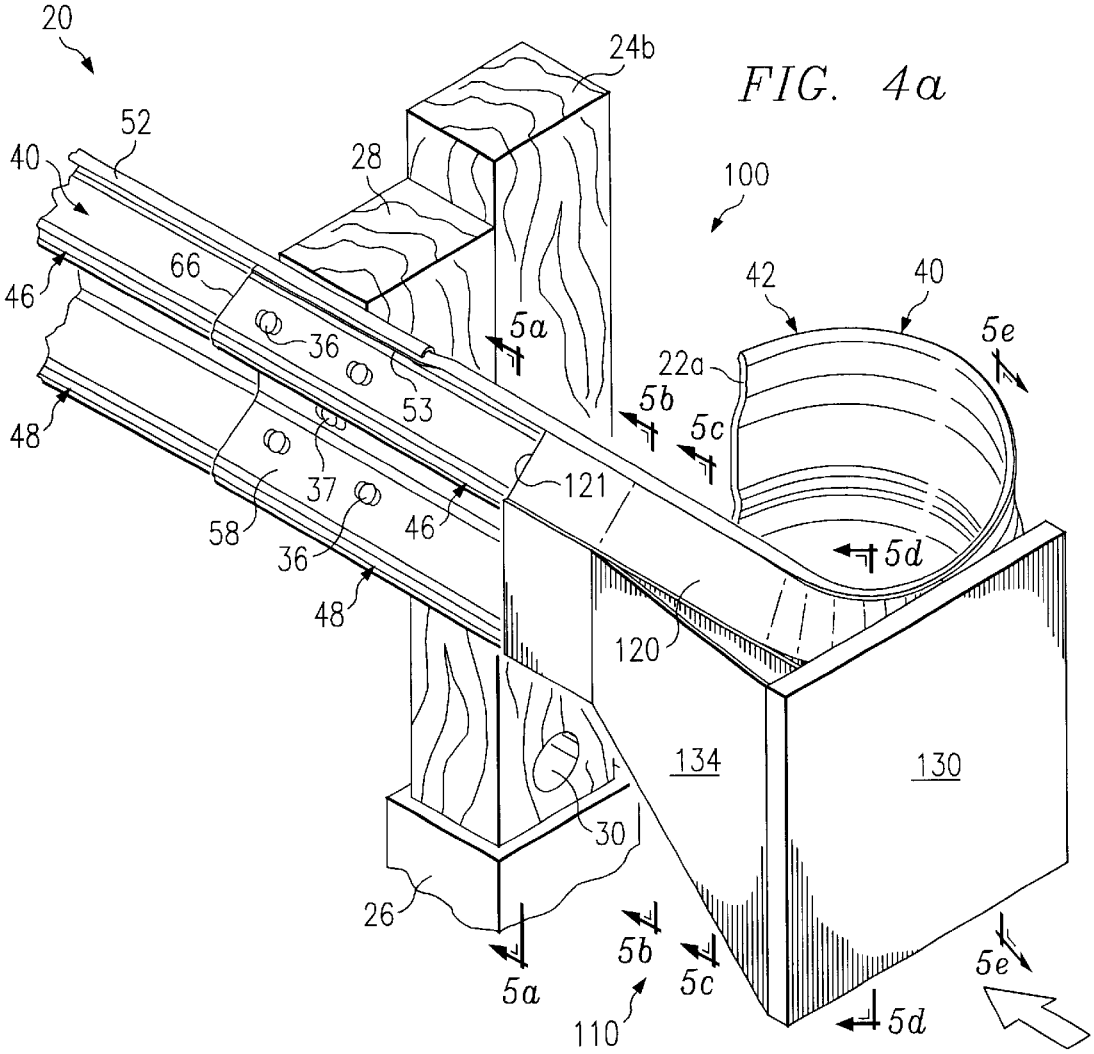
FIG. 4a
FIG. 4b
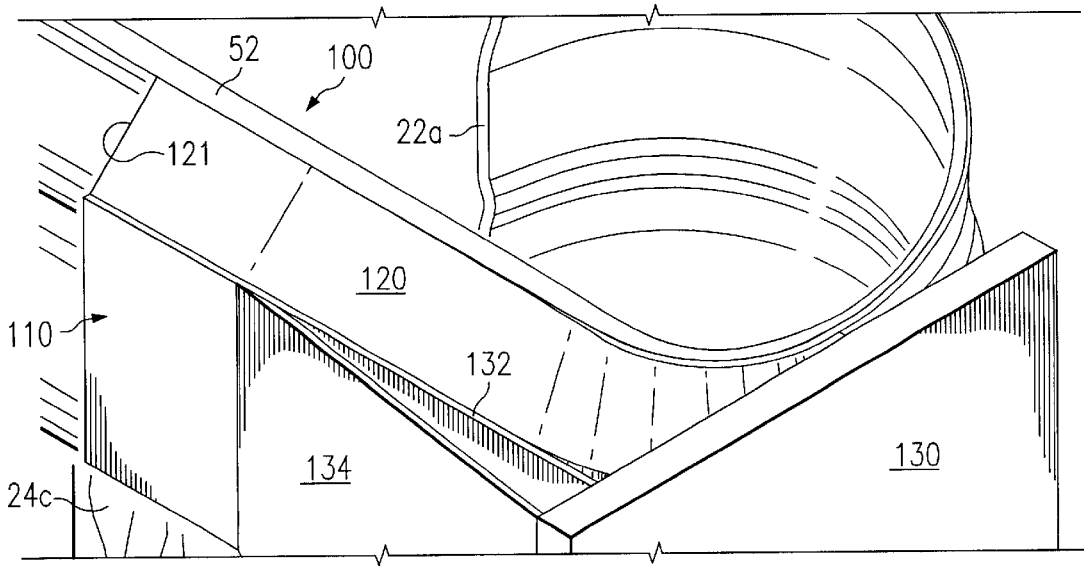

HIGHWAY GUARDRAIL END TERMINAL ASSEMBLY

RELATED APPLICATIONS

This application is related to application Ser. No. 09/405,434 filed Sep. 23, 1999 entitled: Guardrail Beam with Enhanced Stability now issued as U.S. Pat. No. 6,280,427; to copending application Ser. No. 09/663,327 filed Sep. 18, 2000 entitled Guardrail Beam With Enhanced Stability; and to copending application Ser. No. 09/753,868 filed Jan. 2, 2001 entitled Guardrail Beam With Improved Edge Region and Method of Manufacture.

TECHNICAL FIELD OF THE INVENTION

This invention relates to an end terminal assembly for a highway guardrail system having a guardrail mounted on posts and a method for dissipating energy from a vehicle impact with the highway guardrail system as required by applicable federal and state standards including but not limited to crash worthiness requirements.

BACKGROUND OF THE INVENTION

Along most highways and roadways there are hazards which present substantial danger to drivers and passengers of vehicles if the vehicles leave the highway. To prevent accidents from a vehicle leaving the highway, guardrails are often provided along the side of the highway. Experience has shown that guardrails should be installed such that the end of the guardrail facing the flow of oncoming traffic does not present another hazard more dangerous than the original hazard requiring installation of the guardrail. Early guardrails often had no protection at the end facing the oncoming traffic. Sometimes impacting vehicles became impaled on such guardrail ends causing extensive damage to the vehicle and severe injury to the driver and/or passengers. In some reported cases, the guardrail penetrated directly into the passenger compartment of the vehicle fatally injuring the driver and passengers.

Various guardrail designs and end terminal assemblies have been developed to minimize consequences resulting from impact between a vehicle and the end of a guardrail. These designs include tapering the end of the guardrail into the ground to eliminate potential contact with the end of the guardrail. Other types of end terminal assemblies include breakaway cable terminals (BCT), vehicle attenuating terminals (VAT), the Sentre end treatment, and breakaway end terminals (BET).

It is desirable for an end terminal assembly to be usable at either end of a guardrail as a means of both attenuating a head on impact as well as providing an effective anchor for an impact along the side of the guardrail downstream from the end terminal assembly. Examples of such end terminal assemblies are shown in U.S. Pat. No. 4,928,928 entitled Guardrail Extruder Terminal, and U.S. Pat. No. 5,078,366 entitled Guardrail Extruder Terminal.

Guardrail beams and associated guardrail systems have recently been developed to more evenly spread stresses sustained during a vehicle impact to create a more uniform, stable and predictable response. Such guardrail beams preferably include edge treatments such as folds or curls extending along the top edge and the bottom edge of each guardrail beam. The strength of such guardrail beams and ability to resist damage from a vehicle impact generally meets or surpasses current highway safety standards. Such guardrail beams are often lighter in weight than conventional W-beam guardrails having similar overall geometric configurations.

Recently, increased interest in the need for more stringent safety requirements has culminated in the issuance of the National Cooperative Highway Research Program Report 350 (NCHRP 350). The performance standards of NCHRP 350 require all new safety hardware to be tested with larger vehicles than required by previous standards. NCHRP 350 evaluates all safety hardware within three areas: structural adequacy, occupant risk, and vehicle trajectory. Each area has corresponding evaluation criteria. The Federal Highway Administration (FHWA) officially adopted these new performance standards and has ruled that all safety hardware installed after August of 1998 will be required to meet the new standards.

SUMMARY OF THE INVENTION

In accordance with teachings of the present invention, disadvantages and problems associated with previous guardrail end terminal assemblies used to minimize damage to a vehicle caused by colliding with the end of a highway guardrail system have been substantially reduced or eliminated. The present invention substantially reduces manufacturing costs and installation costs of a guardrail end terminal assembly while at the same time allowing the end terminal assembly to effectively anchor an associated guardrail during a downstream rail face impact and to function satisfactorily during a head on impact with the end of the guardrail without excessive damage to the impacting vehicle.

An end terminal assembly formed in accordance with the present invention preferably includes a kinetic energy absorbing assembly for use with a guardrail system having guardrail beams with edge folds or edge curls. The kinetic energy absorbing assembly preferably stretches or flattens guardrail beams having edge curls or edge folds to dissipate kinetic energy and bends the flattened guardrail beams away from a vehicle impacting the end of the guardrail system. For one embodiment the kinetic energy absorbing assembly preferably includes an arcuate shaped tensioning guide which applies opposing forces to respective edge curls or edge folds of the guardrail to stretch the guardrail laterally and to bend the stretched or flattened portion of the guardrail in a direction away from the impacting vehicle. The tensioning guide preferably includes a top flange and a bottom flange which engage respective top edge folds and bottom edge folds at the end of the guardrail during installation of the associated end terminal assembly. The top and bottom flanges of the tensioning guide cooperate with the respective edge folds of the guardrail to provide uniform, optimum alignment of the kinetic energy absorbing assembly with the guardrail. Securely engaging the kinetic energy absorbing assembly as an integral part of the end of the guardrail substantially minimizes the tendency of the kinetic energy absorbing assembly to rotate relative to the guardrail when impacted by vehicle offset from the center of the kinetic energy absorbing assembly or at an angle relative to the kinetic energy absorbing assembly.

An end terminal assembly incorporating teachings of the present invention preferably includes a kinetic energy absorbing assembly which dissipates impact energy by laterally stretching a W-shaped guardrail beam into a relatively flat sheet and bending the flattened guardrail in an arc directed away from an impacting vehicle. The kinetic energy absorbing assembly preferably includes a tensioning guide which may be fabricated from a single piece of sheet metal using conventional metal bending and stamping techniques.

Technical advantages of the present invention include engaging top and bottom flanges of a kinetic energy absorbing assembly which may be integrally engaged with respective edge folds at one end of a guardrail to provide a more stable end terminal assembly. During a vehicle impact with the energy absorbing assembly, the flanges continue to engage the respective edge folds of the guardrail and deform the guardrail in a manner that absorbs kinetic energy from the impacting vehicle. Engagement between the flanges and the respective edge folds maintains stable interaction between the guardrail and the end terminal assembly. Engagement of the flanges with the respective edge folds results in the kinetic energy absorbing assembly becoming and integral part of the guardrail and maintains this integral relationship during a vehicle impact. The integral relationship between the kinetic energy absorbing assembly and the guardrail combines the overall mass of the associated end terminal assembly to more effectively dissipate energy from a vehicle impacting the one end of the guardrail. During a vehicle impact, the response of the end terminal assembly is more stable and more predictable. The end terminal assembly effectively uses characteristics of the attached guardrail beams to improve alignment with other components of the associated highway,guardrail system and to reduce the effects of a vehicle which collides at an angle to or offset from the end of the guardrail. The present invention allows reducing the overall weight of an end terminal assembly as compared with some conventional end terminals while maintaining desired structural stability and energy absorbing capability.

BRIEF DESCRIPTION OF THE DRAWINGS

For a more complete understanding of the present invention, and the advantages thereof, reference is now made to the following written description taken in conjunction with the accompanying drawings, in which:

FIG. 4*a* is a schematic drawing showing an isometric view with portions broken away of the end terminal assembly and associated highway guardrail system of FIG. 1 after a vehicle impact with the end of the highway guardrail system;

FIG. 4*b* is a schematic drawing showing an enlarged view of the engagement between the kinetic energy absorbing assembly and stretched or flattened guardrail beam of FIG. 4*a;*

DETAILED DESCRIPTION OF THE INVENTION

Preferred embodiments of the present invention and its advantages are best understood by referring to the FIGS. 1–10 of the drawings, like numerals being used for like and corresponding parts of the various drawings.

Figure 1:
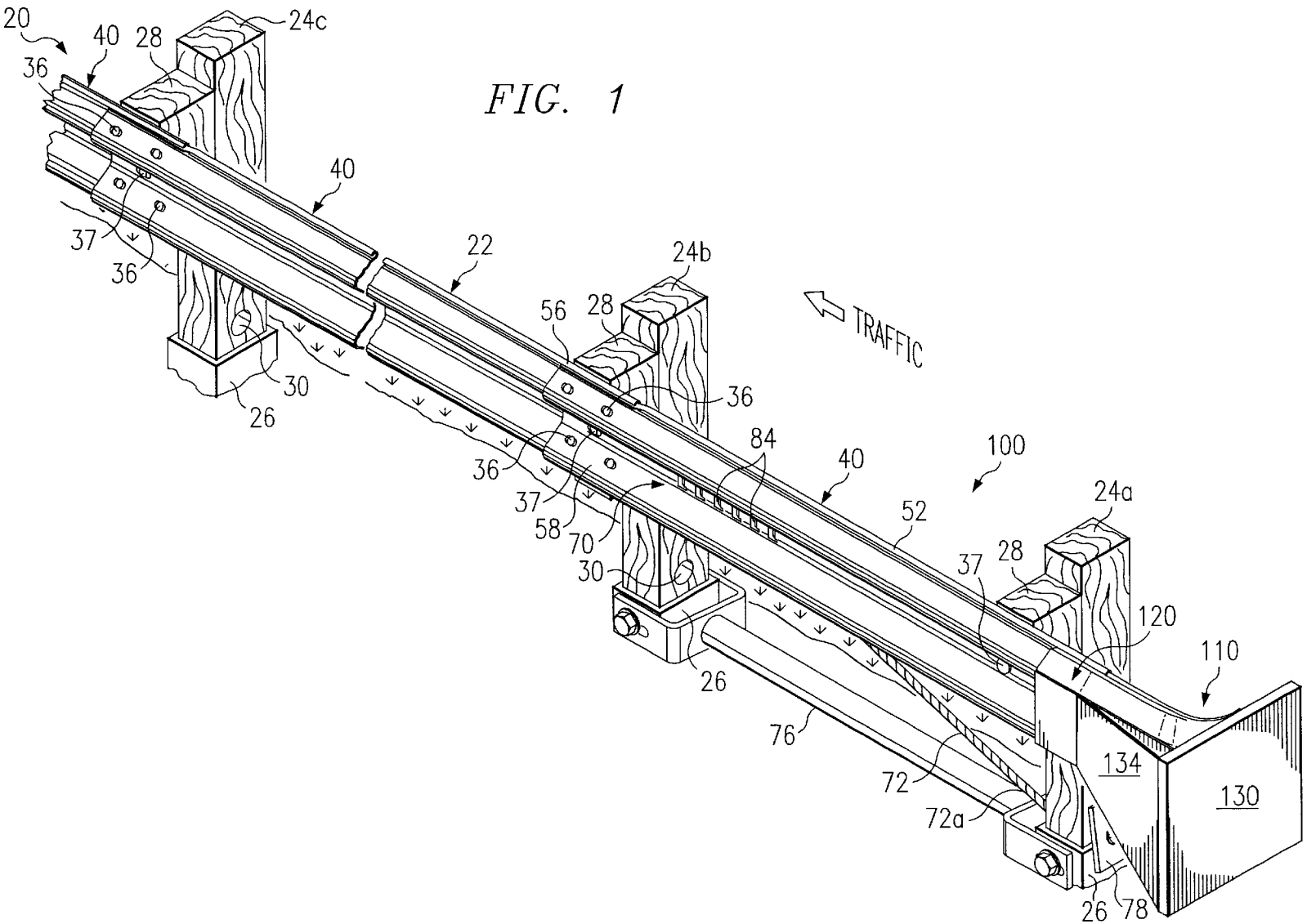
FIG. 1 is an isometric drawing with portions broken away showing a highway guardrail system having an end terminal assembly installed on one end of the highway guardrail system in accordance with teachings of the present invention.
Figure 1A:
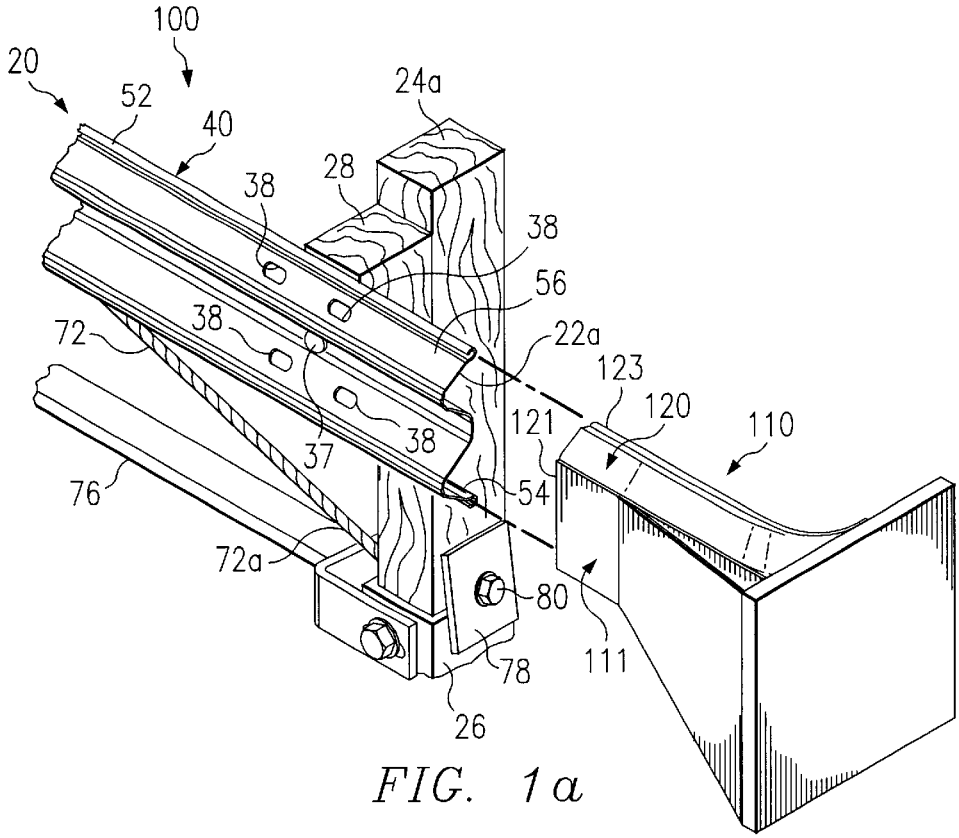
FIG. 1*a* is a schematic drawing showing an exploded isometric view of the one end of the highway guardrail system of FIG. 1 and the associated end terminal assembly.

A highway guardrail system such as guardrail system 20, partially shown in FIGS. 1, 1*a*, and 4*a*, will typically be installed along the side of a highway or roadway (not expressly shown) adjacent to a hazard (not expressly shown) to prevent a vehicle (not expressly shown) from leaving the highway or roadway. Guardrail system 20 preferably includes guardrail 22 mounted on a plurality of posts 24 and end terminal assembly 100 incorporating teachings of the present invention. End terminal assembly 100 is preferably installed at one end of guardrail system 20 facing oncoming traffic.

For purposes of describing various features of the present invention, posts 24 have been designated 24*a*, 24*b* and 24*c*. The number of posts 24 and the length of guardrail 22 depends upon the length land other characteristics associated with the hazard adjacent to the highway or roadway requiring installation of guardrail system 20.

Various components associated with end terminal assembly 100 are shown in FIGS. 1–10. These components include anchor assembly 70 and an appropriate number of posts 24 and guardrail beams 40 as required to satisfactorily install end terminal assembly 100. End terminal assembly 100 is provided to minimize or eliminate the potential for a serious accident from a head on collision with the end of guardrail 22 facing oncoming traffic. End terminal assembly 100 preferably includes kinetic energy absorbing assembly 110 which prevents end 22*a* of guardrail 22 from piercing the vehicle and passenger compartment or causing the vehicle to either roll over or vault guardrail system 20. See FIG. 1*a*. In the event of a collision between a vehicle and the end of guardrail system 20, kinetic energy absorbing assembly 110 dissipates the impact energy of the vehicle without creating an unduly dangerous condition.

As shown in FIGS. 1, 1*a* and 4*a*, posts 24*a*, 24*b*, and 24*c* are made from wood or other suitable types of breakaway material. The types of material which may be satisfactorily used to manufacture posts with desired strength and/or breakaway characteristics appropriate for the specific guardrail system, location of each post and roadside hazard include but are not limited to wood, steel, composite materials and various types of plastics.

Steel foundation tubes 26 may be placed in the ground adjacent to the shoulder of the highway at the desired location for end terminal assembly 100. Posts 24*a*, 24*b*, and 24*c* are then inserted into their respective foundation tubes 26. Various techniques which are well known in the art may be used to satisfactorily install foundation tubes 26 and posts 24 depending upon the type of soil conditions and other factors associated with the highway and the hazard requiring installation of guardrail system 20. In addition to foundation tubes 26, other types of post-to-ground installation systems such as concrete with steel slip base posts and direct drive breakaway posts may be satisfactory used with end terminal assembly 100 incorporating teachings of the present invention.

For some applications, end terminal assembly 100 may include eight wooden posts 24 respectively installed in eight foundation tubes 26. Other applications may require the use of only four wooden posts 24 respectively installed in four foundation tubes 26. The remaining posts (not shown) associated with guardrail system 20 will typically be installed adjacent to the highway without the use of foundation tubes 26. These additional posts may be made from wood, steel, composite materials or any other suitable material.

First post 24*a* is connected to guardrail 22 adjacent to the end of guardrail system 20 facing oncoming traffic. Kinetic energy absorbing assembly 110 is preferably integrally engaged with the end 22*a* of guardrail 22 adjacent to first post 24*a*. See FIGS. 1 and 1*a*. Second post 24*b* is connected to guardrail 22 spaced longitudinally from first post 24*a* with block 28 disposed therebetween. Similar blocks 28 are preferably disposed between post 24*c* and the other posts (not shown) used to support guardrail 22. During a rail face impact between a vehicle and guardrail 22 downstream from end terminal assembly 100, blocks 28 provide a lateral offset between their respective posts 24 and guardrail 22. The distance and direction of the lateral offset is selected to prevent the wheels (not shown) of a vehicle from striking one or more support posts during a rail face impact. Thus, second post 24*b* is preferably installed longitudinally spaced from first post 24*a* and laterally offset from guardrail 22 away from the direction of traffic flow.

As shown in FIG. 1, holes 30 are preferably formed in posts 24*a*, 24*b*, 24*c*, and any other posts associated with end terminal assembly 100 to help provide desired breakaway characteristics required for the specific guardrail system 20. Holes 30 in posts 24*a*, 24*b*, and 24*c* should be aligned parallel with the adjacent highway. As previously noted, posts 24*a*, 24*b*, and 24*c* are preferably inserted into steel foundation tubes 26 which cooperate with holes 30 to establish uniform breakaway characteristics for the respective posts 24*a*, 24*b*, and 24*c*.

Guardrail system 20 is primarily designed and installed along a highway to withstand a rail face impact from a vehicle downstream from end terminal assembly 100. Anchor assembly 70 including cable 72, a cable anchor bracket (not expressly shown), and strut 76 are included as a part of end terminal assembly 100 to provide the desired amount of tension support or anchoring for guardrail 22 during such rail face impact from a downstream vehicle collision. Cable 72 is preferably a breakaway type cable associated with highway guardrail systems and is selected to provide desired tension strength for guardrail 22 during such rail face impact.

One end of cable 72 is preferably secured with first post 24*a* using plate 78 and nut 80. The opposite end of cable 72 is preferably secured to the cable anchor bracket. A plurality of tabs 84 extend outwardly at an acute angle from the cable anchor bracket to releasably anchor the opposite end of cable 72 with a plurality of apertures formed in guardrail 22 between first post 24*a* and second post 24*b*. Strut 76 is preferably installed between and connected to first post 24*a* and second post 24*b* to provide additional structural support for cable 72 and guardrail 22 during downstream rail face impacts.

For purposes of illustrating some of the features of the present invention, end terminal assembly 100 is shown in conjunction with guardrail 22 formed from a plurality of guardrail beams 40. Each guardrail beam 40 has a generally W-shaped cross section along with edge folds or edge curls 52 and 54. For some applications guardrail beams 40 may be installed along substantially the full length of guardrail 22. For other applications, guardrail beams 40 may only be installed as part of end terminal assembly 100. Other portions of guardrail 22 may be formed from various types of guardrail beams such as conventional heavy gauge W-beams (not expressly shown).

Guardrail beams 40 may be secured to posts 24 through a plurality of post bolt slots 39 and corresponding post bolts 37. Similarly, adjacent guardrail beams 40 may be coupled with one another by a plurality of splice bolts 36 extending through respective splice bolt slots 38. The number, size and configuration of bolts 36 and 37, and slots 38 and 39 may be modified as required for guardrail system 20. For one embodiment, the configuration of slots 38 and 39 and bolts 36 and 37 comply with American Association of State Highway Transportation Officials (AASHTO) Designation 180-89. Suitable hardware, including nuts and washers may be provided to secure bolts 36 and 37. Various other mechanical fastening techniques and components may be used.

Guardrail beams 40 are preferably formed from sheets of a base material such as steel alloys suitable for use as highway guardrail. In one embodiment, guardrail beams 40 may also be designed and fabricated according to AASHTO Designation M180-89. Although beams 40 illustrated in FIGS. 1–5*a* have a generally "W-Beam" shape, other shapes, including but not limited to a "Thrie-Beam," may be suitable for use within the teachings of the present invention.

The geometric configuration of guardrail beam 40 enhances its ability to respond in a more uniform and predictable manner during crash testing and in-service impacts or collisions. Guardrail beam 40 comprises front face 41*a*, and a rear face 41*b*, disposed between top edge 42 and bottom edge 44. Front face 41*a* is preferably disposed adjacent to the roadway. First crown 46 and second crown 48 are formed between top edge 42 and bottom edge 44. Each crown 46 and 48 may also include a plurality of fluted beads 50. In a "Thrie-Beam" configuration a third crown (not expressly shown) is included. Top edge 42 and bottom edge 44 terminate at edge folds or edge curls 52 and 54, respectively. For the embodiment illustrated in FIGS. 1–5*a*, folds 52 and 54 turn inwardly toward front face 41*a* of guardrail beam 40. The configuration of edge folds or edge curls 52 and 54 may vary along the length of edges 42 and 44. Various configurations of edge folds 52 and 54 may be used along the top or bottom edge of a particular guardrail beam 40.

Upstream end 56 of each guardrail beam 40 is generally defined as the portion beginning at leading edge 64 and extending approximately thirteen (13) inches along guardrail beam 40 toward trailing edge 66. Similarly, downstream end 58 is generally defined as the portion of guardrail beam 40 beginning at trailing edge 66 and extending approximately thirteen (13) inches toward the associated leading edge 64.

Figure 2:
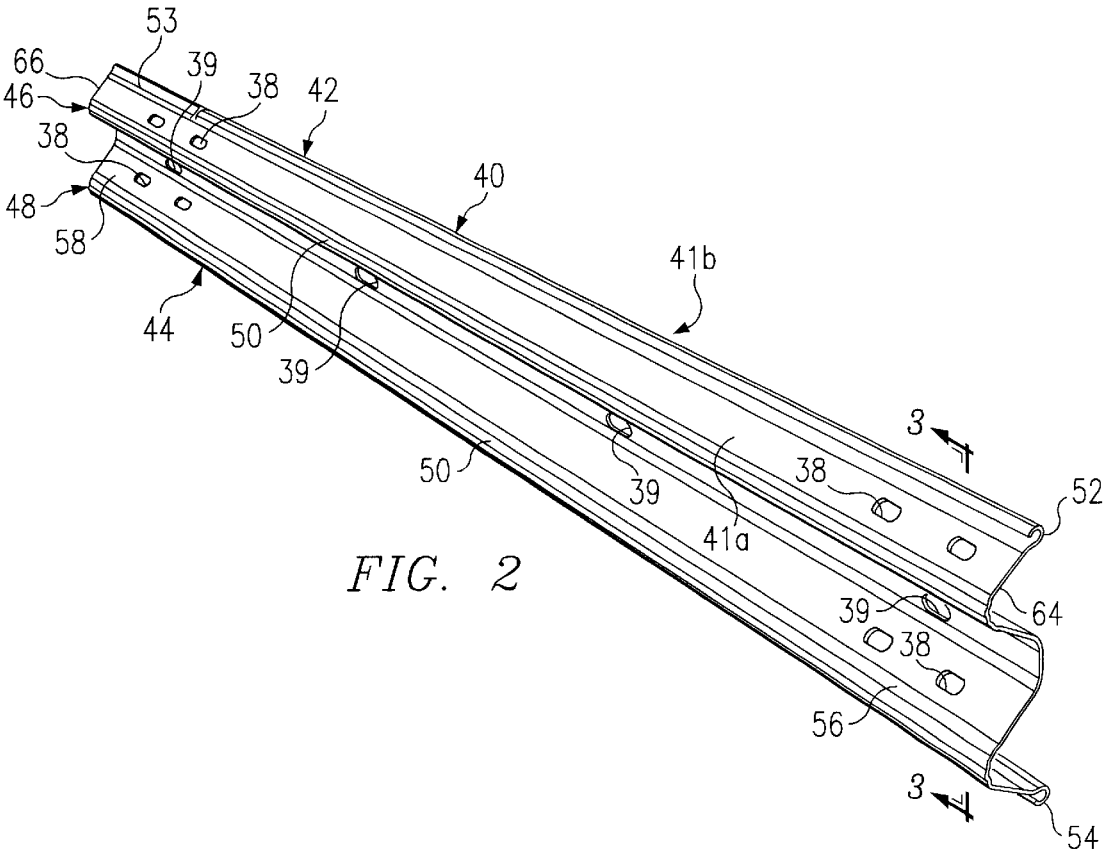
FIG. 2 is a schematic drawing showing an isometric view of a guardrail beam satisfactory for use with an end terminal assembly incorporating teachings of the present invention.

Folds 52 and 54 comprise tubular curls which preferably extend the entire longitudinal length of top edge 42 and bottom edge 44, respectively, with the exception of downstream end 58. Folds 52 and 54 terminate into respective hemmed portions 53 at downstream end 58. Only one hemmed portion 53 is shown in FIG. 2 on top edge 42 adjacent to downstream end 58.

Referring now to FIGS. 1 and 4*a*, splice connections between adjacent guardrail beams 40 are illustrated. Upstream end 56 and downstream end 58 of adjacent guardrail beams 40 are configured to allow folds 52 and 54 of one guardrail beam 40 to interlock with hemmed portions 53 of an adjacent guardrail beam 40. Guardrail beams 40 are typically fabricated from a flexible sheet metal type material which allows adjacent beams to be deformed and "snapped" together to form the interlock at each splice connection. In practice, the interlock between adjacent guardrail beams 40 is formed in a nested fashion, as opposed to adjacent guardrail beams 40 sliding together.

The interlock or integral engagement at each splice connection helps keep guardrail beams 40 in alignment, with respect to each other, during a crash event. The interlock also operates to force loads encountered by guardrail system 20 during a crash event in an axial direction along guardrail 22. This load path is optimum for bolted-joint, splice connection performance and for the overall uniform response of guardrail system 20. This results in maximum energy dissipation from a colliding vehicle and thus, the optimum overall performance of guardrail system 20 is achieved.

Kinetic energy absorbing assembly 110 which is attached to end 22*a* of guardrail 22 also forms a similar type of interlock or integral engagement. The configuration of guardrail beam 40 which provides the desired interlocking relationship also provides an optimum load path with respect to kinetic energy absorbing assembly 110. Integral engagement of kinetic energy absorbing assembly 110 with the associated upstream end 56 of guardrail beam 40 results in more stable and more predictable energy dissipation from a vehicle colliding with the end of guardrail system 20. Integral engagement formed at the end of guardrail system 20 between adjacent guardrail beam 40 and kinetic energy absorbing assembly 110 provides a more predictable response to an externally applied force, for example, a crash event.

In some existing guardrail end terminals, adjacent guardrail beams may too easily become dislodged from their respective support posts in the following manner. A bending force is exerted by the end terminal as it tries to fully engage the guardrail. This force which is transmitted through the guardrail beam or directly at a support post causes early separation of the guardrail beams from the post that may cause the end terminal not to function properly. In contrast, the established integration and interlock between adjacent guardrail beam 40 and impact absorbing assembly 110 of the present invention minimizes such detrimental non-uniform bending of guardrail beam 40 and allows adjacent guardrail beams 40 to remain in position axially relative to one another ahead of the assembly 110 by minimizing local bending in the vertical plane or separation of the splice connections. In addition, when energy absorbing assembly 110 is impacted directly by an external force, non-uniform deformation and thus local concentration of stresses that may cause failure are substantially minimized in the integrated system.

Some additional fabrication details of energy absorbing assembly 110 are as follows. The extreme edges of hemmed portions 53, at their termination adjacent trailing edge 66, may be chamfered (not expressly shown), at approximately a forty-five-degree angle. Also, hemmed portions 53 may be trimmed and any rough edges mitered. In this manner, the extreme corners and edges of hemmed portions 53 are less likely to tear edge folds 52 and 54 of an adjacent guardrail beam 40. This accommodates axial sliding of one guardrail beam 40 with respect to an adjacent guardrail beam 40 without forming a snag or tear. The chamfered edges are particularly useful where hemmed portions 53 are coupled with folds 52 and 54 of adjacent guardrail beam 40, but also provide similar advantages where guardrail beam 40 is spliced with a conventional guardrail beam (not expressly shown).

Figure 3:
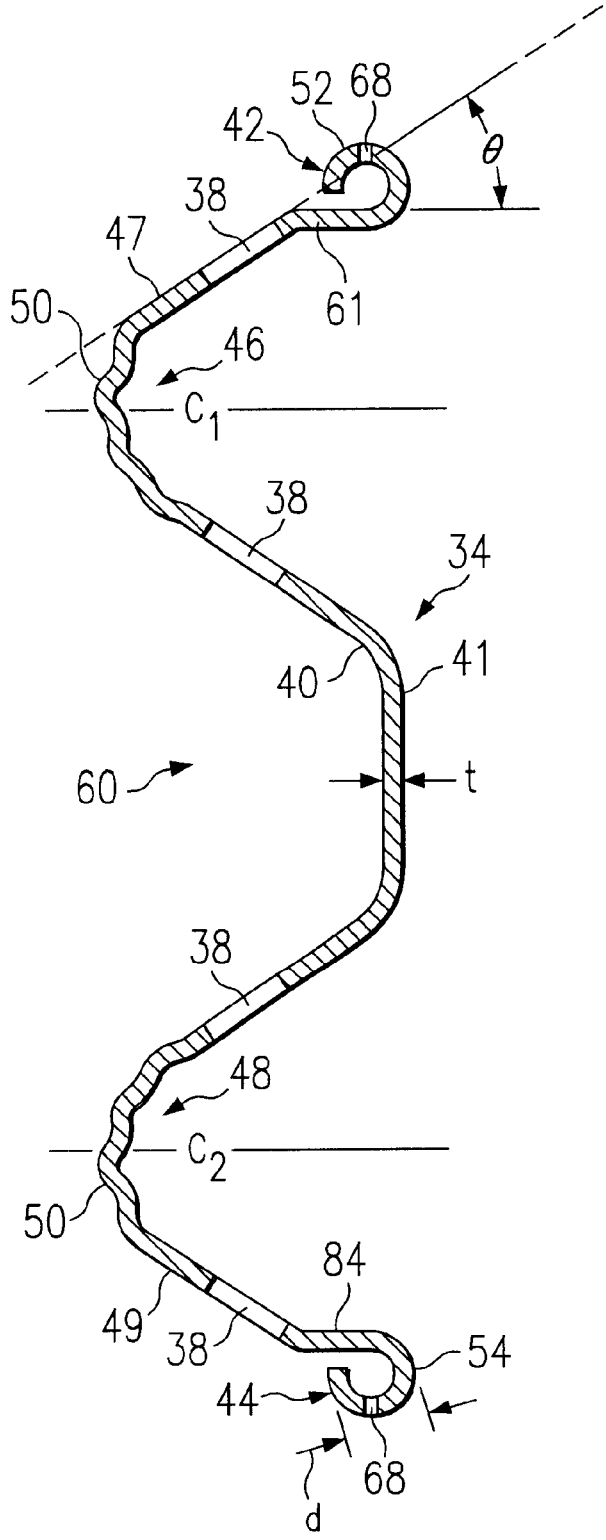
FIG. 3 is a schematic drawing in section taken along lines 3—3 of the guardrail beam of FIG. 2.
Figure 5E:
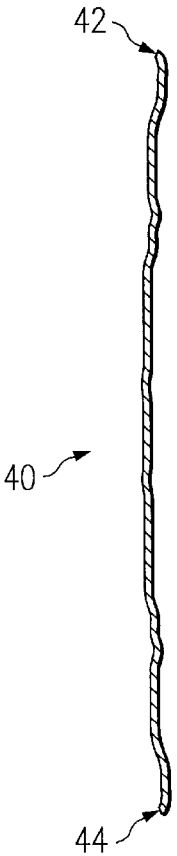
FIGS. 5*a* through 5*e* are schematic drawings in section of a stretched or flattened guardrail beam taken along respective lines 5*a*—5*a*, 5*b*—5*b*, 5*c*—5*c*, 5*d*—5*d* and 5*e*—5*e* of FIG. 4*a;*
Figure 5D:
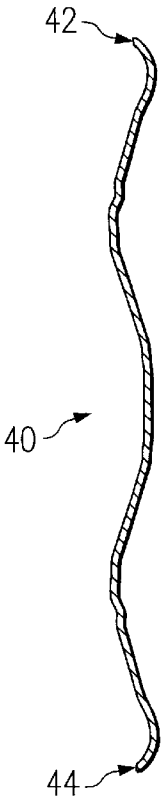
Figure 5C:
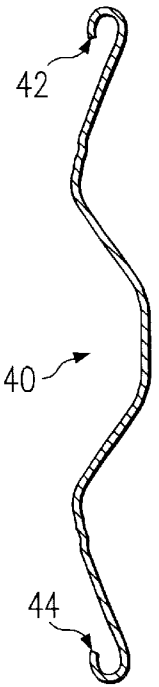
Figure 5B:
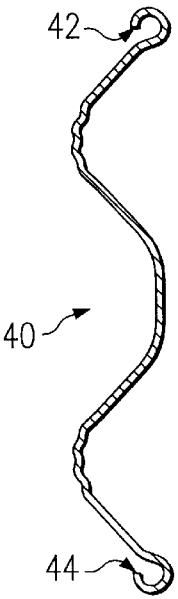
Figure 5A:
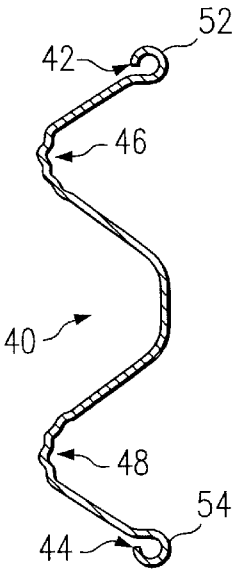
Figure 6:
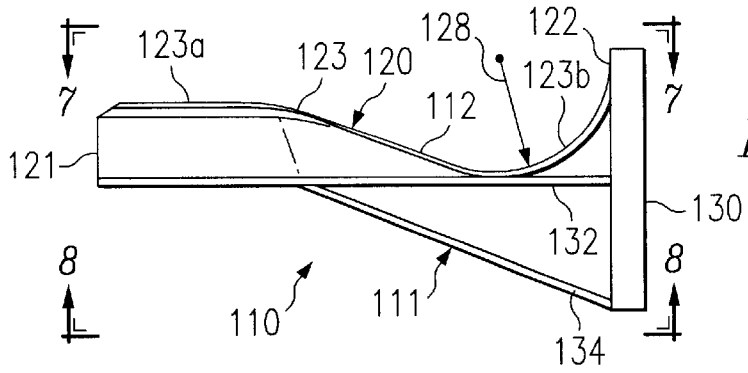
FIG. 6 is a schematic drawing showing a plan view of a kinetic energy absorbing assembly formed in accordance with teachings of the present invention.

As illustrated in FIG. 3, a plurality of weep holes 68 may be incorporated into edge folds 52 and 54. Weep holes 68 prevent the buildup of water within the lowermost edge fold 54. This operates to drain any water which collects in edge fold 54 and prevent a buildup which may lead to corrosion. Advanced local corrosion could potentially create weak points and contribute to the failure of guardrail beam 40.

Edge folds 52 and 54 and the overall geometry of guardrail beam 40 allows a combination between guardrail beams 40 and conventional guardrail beams within a single guardrail system. Accordingly, end terminal assembly 100 may be incorporated into existing guardrail systems as needed, and an entire retrofit of any particular guardrail system is not required in order to recognize benefits of the present invention.

The cross sectional configuration of edge folds 52 and 54, taken through upstream end 56, is illustrated in FIG. 3. Edge folds 52 and 54 have the general configuration of tubular curls with a generally circular cross section extending approximately two hundred and seventy degrees (270° )of a unit circle centered within folds 52 and 54. Folds 52 and 54 may have an outer diameter of approximately three-fourths of an inch (¾") for some highway safety systems.

The cross section of FIG. 3 illustrates a plurality of fluted beads 50 associated with first crown 46 and second crown 48. Fluted beads 50 effectively redistribute material cross sectionally from areas of less significance to areas of critical importance during a crash event. Fluted beads 50 direct deformation of guardrail beam 40 in a direction parallel to guardrail beam 40, thus absorbing more energy by strengthening guardrail beam 40 in the longitudinal direction.

Although three fluted beads 50 are illustrated on each crown 46 and 48 in the embodiment of FIG. 3B, the total number of fluted beads 50 may be increased or decreased according to various design considerations within the teachings of the present invention. For one embodiment, all of the fluted beads 50 occurring upon first crown 46 are within one and one-half inches of center line C1. Similarly, all of the fluted beads 50 associated with second crown 48 may be within one and one-half inches of centerline C2. In the illustrated embodiment, fluted beads 50 are generally rounded and a smooth transition is provided between adjacent fluted beads 50. This minimizes stress concentration points typically associated with sharp transitions or bends. These shapes are also easier to manufacture and provide reduced wear and tear on tools of manufacture.

Splice bolt hole 38 is formed within an upper face 47 of guardrail beam 40. Upper face 47 terminates at a curl flange 61. Curl flange 61 forms the transition between upper face 47 and edge fold 52. Curl flange 61 and edge fold 52 cooperate to form an edge stiffener for the section below top edge 42. This minimizes possible buckling of the entire guardrail beam 40 during a crash event.

As illustrated in FIG. 3, an angle θ is formed at the transition between upper face 47 and curl flange 61. In the illustrated embodiment, θ is approximately equal to thirty degrees. This enables an edge-stiffener behavior and also facilitates incorporation of guardrail beams 40 into existing guardrail systems. Angle θ may be significantly modified within the teachings of the present invention.

A vehicle traveling along the right side of a roadway will approach from upstream end 56 or leading edge 64 and subsequently depart from downstream end 58 or trailing edge 66 of guardrail beam 40. Each guardrail beam 40 is preferably joined with additional guardrail beam 40 such that they are lapped in the direction of oncoming traffic to prevent edges which may "snag" a vehicle or object as it travels along front face 41*a* of guardrail beam 40. Accordingly, a first guardrail beam 40 is installed on front face 41*a* at leading edge 64 of a second guardrail beam 40, typically forming an overlap of approximately thirteen inches. Another guardrail beam 40 installed at trailing edge 66 may be installed upon the rear face 41*b* of guardrail beam 40, forming an overlap of approximately thirteen inches.

Conventional guardrail beams do not contain edge folds 52 and 54 and typically terminate with "blade edges" at the top and bottom of the cross section. These edges are susceptible to imperfections in the sheet of base material as well as damage during manufacture, shipping, handling, and installation. Imperfections along the edges of conventional guardrail beams may become stress concentration points or focal points at which failure of the guardrail can initiate during impact, and frequently results in tearing of the guardrail.

Even a perfect, smooth "blade edge" of a conventional "W-beam" will experience a very localized point of high stress gradient due to the characteristic edge stress concentration associated with open sections of guardrail under bending loads. Thus, initiation of an edge "bulge" or "crimp" on a perfect, smooth blade edge is an imperfection that will grow or propagate easily and rapidly. This stress concentration may be made worse by the presence of any relatively small edge imperfections, even those on the order of size of the thickness of the sheet of base material used to fabricate conventional guardrail beams.

Kinetic energy absorbing assembly 110 as illustrated in FIGS. 1, 1*a*, 4*a*, 4*b* and 6–10 includes tensioning guide 120 which dissipates energy of a vehicle impacting the end of guardrail system 20 by stretching and flattening guardrail beams 40 and deflecting flattened guardrail beams 40 in an arc away from the highway and impacting vehicle. Tensioning guide 120 includes first end 121 and second end 122 with first flange 123 and second flange 124 extending longitudinally therebetween. See FIGS. 6–10. Tensioning guide 120 preferably has a generally arcuate shape intermediate first end 121 and second end 122. Kinetic energy absorbing assembly 110 also includes front face 111 and rear face 112.

Figure 7:
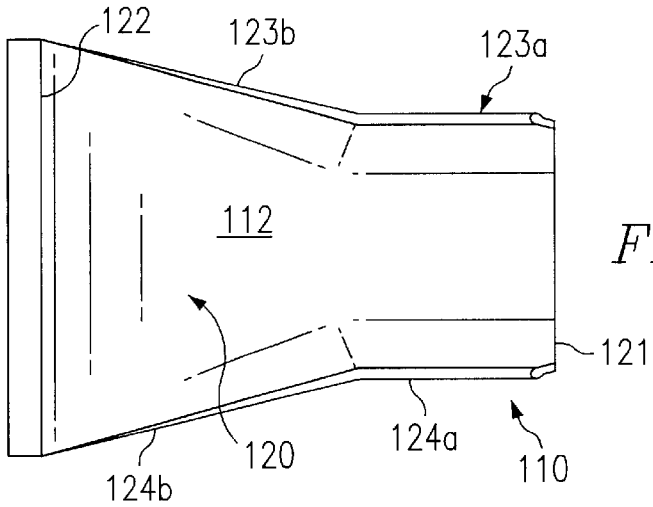
FIG. 7 is a schematic drawing showing an elevational view of the kinetic energy absorbing assembly taken along lines 7—7 of FIG. 6.
Figure 8:
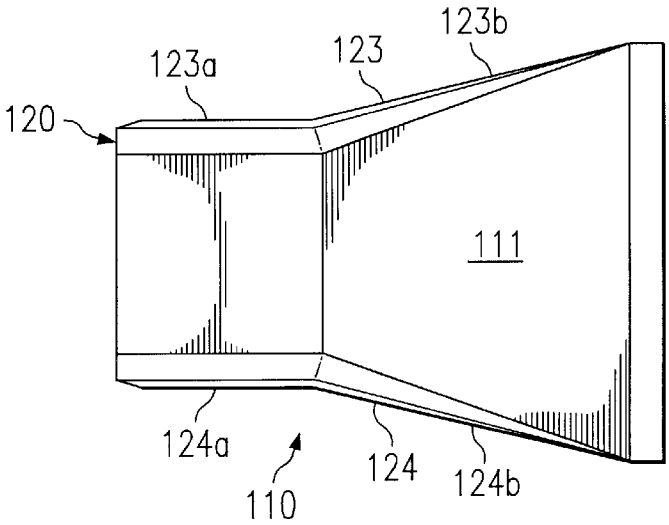
FIG. 8 is a schematic drawing showing an elevational view of the kinetic energy absorbing assembly taken along lines 8—8 of FIG. 6.
Figure 9:
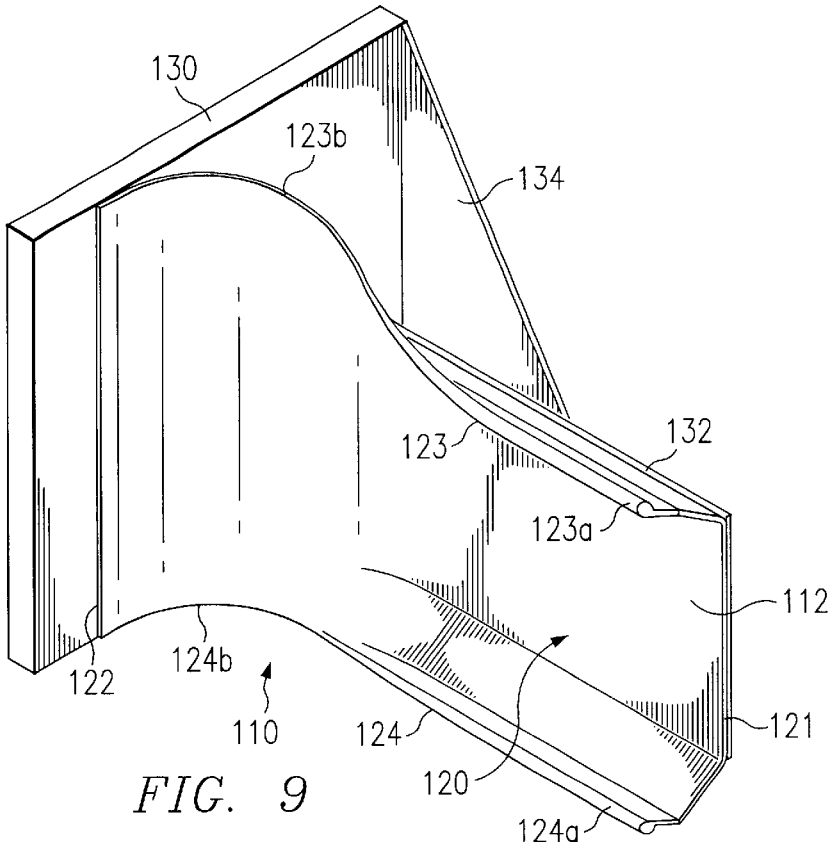
FIG. 9 is a schematic drawing showing an isometric view of the kinetic energy absorbing assembly FIG. 6.
Figure 10:
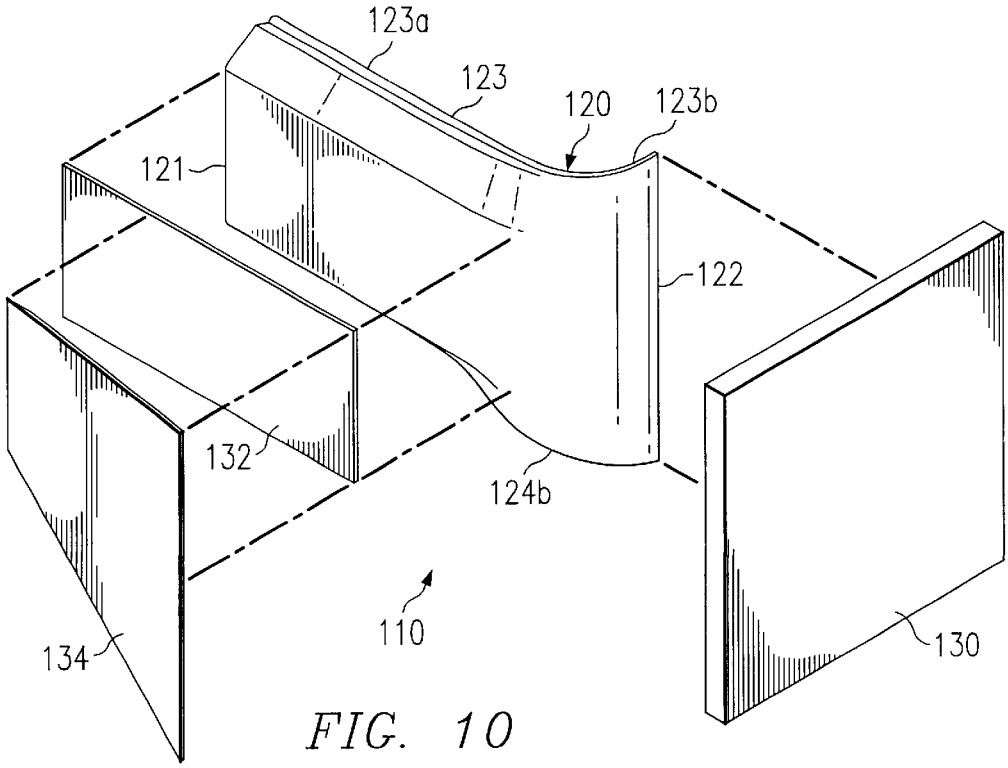
FIG. 10 is a schematic drawing showing an exploded view of components associated with the kinetic energy absorbing assembly of FIG. 6.

First end 121 of tensioning guide 120 is preferably formed with a configuration and dimensions compatible with integrally engaging kinetic energy absorbing assembly 110 with end 22*a* of guardrail 22. For one embodiment of the present invention, first end 121 as shown in FIGS. 7 and 9 preferably is a cross section corresponding with the general configuration of an open trapezoid. Second end 122 of tensioning guide 120 is defined in part by a generally flat surface extending between first flange 123 and second flange 124. At first end 121 first flange 123 and second flange 124 are preferably spaced from each other a first distance corresponding with the distance between edge curls 52 and 54 of guardrail beam 40 at the end of guardrail 22. At second end 122, first flange 123 and second flange 124 are preferably spaced from each other a second distance corresponding approximately with the width of a sheet of material from which guardrail beam 40 was formed. The second distance between first flange 123 and second flange 124 is selected to be larger than the first distance such that movement of tensioning guide 120 relative to guardrail 22 will stretch and generally flatten portions of guardrail 22 engaged with first flange 123 and second flange 124 to dissipate kinetic energy from an impacting vehicle. See FIGS. 5*a*–5*e*.

First flange 123 and second flange 124 at first end 121 of tensioning guide 120 preferably have configurations corresponding generally with the inside diameter of respective edge curls 52 and 54. As shown in FIGS. 1*a* and 4*a*, first flange 123 is preferably inserted into edge curl 52 and second flange 124 preferably inserted into edge curl 54 during integral engagement of kinetic energy absorbing assembly 110 with end 22*a* of guardrail 22. The dimensions and configuration of edge curls 52 and 54 and first flange 123 and second flange 124 are preferably selected to result in kinetic energy absorbing assembly 110 becoming an integral part of guardrail 22.

For some applications, conventional metal working techniques such as bending and/or stamping may be used to form tensioning guide 120 from a strip of metal similar to the types of metal used to form guardrail beam 40. The strip of metal used to form tensioning guide 120 (not expressly shown) may be twice as thick as the strip of metal used to form guardrail beam 40. Portions of first flange 123 and second flange 124 adjacent to first end 121 may also be formed from edge folds and/or edge curls (not expressly shown). Forming first flange 123 and second flange 124 using edge folds and/or edge curls will increase the strength of the respective flange and optimize interaction of tensioning guide 120 with an associated guardrail beam 40.

For the embodiment of the present invention as shown in FIGS. 6–10, first flange 123 and second flange 124 will be described as having respective portions 123*a* and 124*a* extending from first end 121 and second portions 123*b* and 124*b* extending from second end 122. Portions 123*a* and 124*a* of first flange 123 and second flange 124 extend generally parallel with each other. The spacing between portions 123*a* and 124*a* correspond generally with the distance between first edge curl 52 and second edge curl 54 of guardrail beam 40.

Portions 123*b* and 124*b* are preferably formed with a gradual taper relative to each other along the length of tensioning guide 120 between respective portions 123*a* and 124*a* and second end 122 of tensioning guide 120. The amount of taper associated with portions 123*b* and 124*b* is preferably selected to gradually stretch the associated guardrail beam 40 in a controlled manner without buckling or tearing portions of guardrail beam 40 which are integrally engaged with tensioning guide 120. See FIGS. 5*a*–5*e*.

Tensioning guide 120 preferably has a generally arcuate shape disposed between first end 121 and second end 122. For the embodiment of a present invention as shown in FIGS. 6–10, the arcuate shape of tensioning guide 120 is defined in part by radius 128. The contour of the arcuate portion of tensioning guide 120 is selected to deflect stretched and flattened portions of guardrail beams 40 away from front face 111 of kinetic energy absorbing assembly 110.

The arcuate shape of tensioning guide 120 is not a primary means of dissipating kinetic energy from an impacting vehicle. For the embodiment of the present invention as shown in FIGS. 6–10, the arcuate shape of tensioning guide 120 is preferably selected to direct stretched and flatten portions of guardrail 120 at an angle somewhat less than ninety degrees (90°) relative to longitudinal direction of guardrail 22. For other applications a tensioning guide may be formed in accordance with teachings the present invention to deflect stretched and flatten guardrail beams at an angle greater than ninety degrees or less than ninety degrees relative to an associated guardrail and adjacent highway or roadway. The accurate shape of tensioning guide 120 is preferably selected to direct stretched and flattened guardrail beams away from an impacting vehicle and the associated roadway or highway.

Tensioning guide 120 and particularly first flange 123 and second flange 124 are formed in accordance with teachings of the present invention to control the motion of kinetic energy absorbing assembly 110 along guardrail 22 to maintain optimum alignment and support during a vehicle impact with the end of guardrail 22. Since end 22*a* of guardrail 22 is generally unsupported, first flange 123 and second flange 124 are able to stretch attached portions of guardrail beam 40 as kinetic energy absorbing assembly 110 moves relative to guardrail 22. The dimensions and configuration of first flange 123 and second flange 124 are preferably selected such that the stretching and flattening process is initiated relatively gradually as an attached guardrail beam 40 moves from first end 121 to second end 122.

Forming kinetic energy absorbing assembly 110 in accordance with teachings of the present invention provides an integration of the assembly 110 with guardrail beam 40 that permits minimization of a sudden initiation of forces during impact by a vehicle which may rip or tear adjacent guardrail beam 40 without adequately dissipating any substantial amount of kinetic energy. This is a notable improvement over some present systems in use today, and is a novel safety feature. As kinetic energy absorbing assembly 110 moves relative to guardrail beam 40, the integral coupling of guardrail 22 with first flange 123 and second flange 124 permits the system to more smoothly reach and maintain its full kinetic energy absorbing capability. As a result, even relatively high speed impacts may be better absorbed in most cases without undue sudden shock (deceleration) to an impacting vehicle or its occupants.

For the embodiment of the present invention as shown in FIGS. 6–10, kinetic energy absorbing assembly 110 preferably includes impact plate or striking plate 130, first supporting member 132 and second supporting member 134. Impact plate 130 is preferably disposed on the end of kinetic energy absorbing assembly 110 facing oncoming traffic. For the embodiment of the present invention as represented by kinetic absorbing assembly 110, impact plate 130 preferably has a generally square configuration for the sake of simplicity. For other applications impact plate 130 may have a rectangular configuration or any other configurations as desired for the associated highway safety system. Impact plate 130 is preferably attached to tensioning guide 120 proximate second end 122 of tensioning guide 120 so that impact plate 130 will face oncoming traffic when first end 121 of tensioning guide 120 is integrally engaged with end 22*a* of guardrail 22.

For some embodiments first supporting member 132 may be attached to tensioning guide 120 to provide additional support for first flange 123 and second flange 124. Second supporting member 134 may also be attached to first supporting member 132 and impact plate 130. Supporting members 132 and 134 cooperate with each other to transmit kinetic energy from an impacting vehicle to tensioning guide 120.

For some embodiments first supporting member 132 and/or second supporting member 134 may be formed as integral components of tensioning guide 120. For other embodiments first supporting member 132 and/or second supporting member 134 may be formed as separate components which are later attached to tensioning guide 120 using conventional fabrication and assembly techniques.

During a vehicle collision with impact plate 130 at the extreme end of end terminal assembly 100, kinetic energy absorbing assembly 110 will typically move down the length of guardrail 22. Integral engagement of first flange 123 and second flange 124 with respective edge curls 52 and 54 guide movement of kinetic energy absorbing assembly 110 relative to guardrail 22 to sequentially stretch and flatten guardrail beams 40 installed as part of end terminal assembly 100 until the kinetic energy of the impacting vehicle has been dissipated. Integral engagement between first flange 123, second flange 124 and respective edge curls 52 and 54 also resists rotation of kinetic energy absorbing assembly 110 relative to guardrail 22 during an impact or collision. If kinetic energy absorbing assembly 110 were to significantly rotate, then an impacting vehicle might be subject to a much larger rate of deceleration which might result in greater damage to the vehicle and serious injury to its occupants.

Previously discussed posts 24 are preferably selected to bend or break away upon vehicle impact with the extreme end of guardrail 22. In addition, one or more flanges (not expressly shown) may be attached to kinetic energy absorbing assembly 110 to deflect posts 24 away from an impacting vehicle. The additional flanges may also serve to absorb kinetic energy and thus further minimize damage to the vehicle or injury to its occupants.

As best shown in FIGS. 5*a*–5*e* as kinetic energy absorbing assembly 110 and guardrail 22 move relative to each other, each guardrail beam 40 will be stretched and flattened. This stretching and flattening process dissipates kinetic energy from an impacting vehicle in a relatively smooth manner in order to minimize damage to the impacting vehicle and/or injury to occupants of the impacting vehicle. When guardrail beams 40 have been stretched and flattened, their resistance to bending is substantially reduced. Thus, the accurate portion of tensioning guide 120 may smoothly deflect stretched and flattened portions of guardrail beam 22 in an arc away from the impacting vehicle.

Prior to a vehicle collision with impact plate 130, cable 72 is taunt with first portion 72*a* secured with first post 24*a* and tabs 84 inserted into corresponding apertures to releasably secure the cable anchor bracket with guardrail 22. Following an initial head on impact of a vehicle with impact plate 130 and the initiation of stretching, flattening and deflecting of guardrail 22, the impacting vehicle and kinetic absorbing energy assembly 110 will engage first post 24*a* breaking it at the top of the associated foundation tube 26. Breaking first post 24*a* will release first portion 72*a* of cable 72. As kinetic absorbing energy assembly 110 continues moving down guardrail 22, it will engage the cable anchor bracket. Since the tension in cable 34 has been released, engagement of kinetic absorbing energy assembly 110 with the cable anchor bracket moves tabs 84 out of their associated apertures releasing the cable anchor bracket and second cable portion 72*b* from guardrail 22. Cable 72 and the cable anchor bracket can now move out of the path of kinetic absorbing energy assembly 110 and avoid possibly blocking movement of kinetic absorbing energy assembly 110.

For some applications a special coating or lubricant may be applied to portions of first flange 123 and second flange 124 which are integrally engaged with respective edge curls 52 and 54. Examples of such special coatings and/or lubricants include zinc alloys, polyethylene plastic and carbon black. The use of such special coatings and lubricants may improve the interaction between kinetic energy absorbing assembly 110 and attached portions of guardrail 22.

Guardrail beams having various types of edge folds and/or edge curls may be satisfactorily used with a tensioning guide formed in accordance with teachings of the present invention. The dimensions and configuration of the edge folds or edge curls must be satisfactory to permit engagement with the first flange and the second flange of the tensioning guide to allow stretching and flattening of attached portions of the guardrail. A tensioning guide may be formed in accordance with teachings of the present invention to engage edge folds or edge curls which may be turned toward the front face of a guardrail or turned toward the rear face of the guardrail.

Although the present invention and its advantages have been described in detail it should be understood that various changes, substitutions, and alterations can be made hereto without departing from the spirit and scope of the invention as defined by the following claims.

What is claimed is:

1. A kinetic energy absorbing assembly for an end terminal assembly of a guardrail system defined in part by a guardrail mounted on a plurality of posts comprising:

a tensioning guide having a first end and a second end with a first flange and a second flange extending between the first end and the second end;

the first end of the tensioning guides having dimensions compatible with integrally engaging the first end of the tensioning guide with one end of the guardrail;

the first flange and the second flange having configurations corresponding generally with respective edge curls formed on the one end of the guardrail and sized to allow inserting the first flange and the second flange respectively into the edge curls to engage the kinetic energy absorbing assembly as an integral part of the guardrail;

the first flange and the second flange spaced from each other by a first distance at the first end of the tensioning guide and spaced from each other by a second distance at the second end of the tensioning guide; and the second distance selected to be larger than the first distance whereby movement of the tensioning guide relative to the guardrail will stretch portions of the guardrail engaged with the first flange and the second flange to dissipate kinetic energy from an impacting vehicle and having an impact plate attached proximate the second end of the tensioning guide whereby the impact plate will face oncoming traffic when the first end of the tensioning guide is engaged with the one end of the guardrail.

2. The kinetic energy absorbing assembly of claim 1 further comprising an arc formed in the tensioning guide between the first end and the second end to direct stretched and flattened portions of the guardrail away from the impacting vehicle.

3. The kinetic energy absorbing assembly of claim 1 further comprising at least one supporting member attached to the tensioning guide and the impact plate to transmit kinetic energy from the impacting vehicle to the tensioning guide.

4. The kinetic energy absorbing:assembly of claim 1 further comprising the impact plate having a generally rectangular configuration.

5. The kinetic energy absorbing assembly of claim 1 further comprising the tensioning guide having a front face and a rear face.

6. The kinetic energy absorbing assembly of claim 5 further comprising a radius of curvature formed in the tensioning guide between the first end and the second end whereby portions of the guardrail, after being stretched and flattened, will be bent away from the front face.

7. The kinetic energy absorbing assembly of claim 1 further comprising the second distance between the first flange and the second flange approximately equals the width of a sheet of material from which the guardrail was formed.

8. The kinetic energy absorbing assembly of claim 1 further comprising the impact plate having a generally square configuration.

9. The kinetic energy absorbing assembly of claim 1 further comprising:

the first end having a cross section with the general configuration of an open trapezoid; and the second end of the tensioning guide defined in part by a generally flat surface extending between the first flange to the second flange.

* * * * *